US008621711B2

(12) United States Patent
Wagner

(10) Patent No.: US 8,621,711 B2
(45) Date of Patent: Jan. 7, 2014

(54) FURNITURE GLIDE

(75) Inventor: Roland Wagner, Lahr (DE)

(73) Assignee: Wagner-System GmbH, Lahr (DE)

( * ) Notice: Subject to any disclaimer, the term of this patent is extended or adjusted under 35 U.S.C. 154(b) by 0 days.

(21) Appl. No.: 13/318,076

(22) PCT Filed: May 10, 2010

(86) PCT No.: PCT/EP2010/002869

§ 371 (c)(1),
(2), (4) Date: Dec. 28, 2011

(87) PCT Pub. No.: WO2011/157385

PCT Pub. Date: Dec. 22, 2011

(65) Prior Publication Data

US 2012/0174340 A1 Jul. 12, 2012

(30) Foreign Application Priority Data

May 10, 2009 (DE) ..... 20 2009 006 740 U
Nov. 13, 2009 (DE) ..... 20 2009 015 381 U

(51) Int. Cl.
*A47B 91/04* (2006.01)

(52) U.S. Cl.
USPC ..... 16/42 R; 16/42 T; 248/188.9

(58) Field of Classification Search
USPC ..... 16/42 R, 42 T, 18 R, 30; 248/188.9, 248/188.8, 346.11, 677; 297/463.1
See application file for complete search history.

(56) References Cited

U.S. PATENT DOCUMENTS

| | | | | | |
|---|---|---|---|---|---|
| 1,855,625 | A * | 4/1932 | Darnell | 16/42 R |
| 2,633,599 | A * | 4/1953 | Dolan | 16/42 R |
| 2,738,541 | A * | 3/1956 | Thornsbury | 16/42 R |
| 2,794,205 | A * | 6/1957 | Skupas | 16/42 R |
| 3,038,194 | A * | 6/1962 | Arenson | 16/43 |
| 3,166,782 | A * | 1/1965 | Miller | 16/42 R |
| 7,234,200 | B2 * | 6/2007 | Chase | 16/42 R |
| 7,404,232 | B2 * | 7/2008 | Chase | 16/42 T |
| 7,533,858 | B2 * | 5/2009 | Straus | 248/188.8 |
| 7,757,346 | B2 * | 7/2010 | Chase | 16/42 R |
| 8,037,574 | B2 * | 10/2011 | Chase | 16/42 R |
| 2008/0178430 | A1 * | 7/2008 | Berthiaume et al. | 16/42 T |
| 2008/0209685 | A1 * | 9/2008 | Dombroski et al. | 16/42 R |
| 2011/0197390 | A1 * | 8/2011 | Carpinella et al. | 16/30 |

FOREIGN PATENT DOCUMENTS

| | | | |
|---|---|---|---|
| DE | 20007892 | U1 * | 12/2000 |
| DE | 202009006740 | U1 * | 8/2009 |

* cited by examiner

*Primary Examiner* — William Miller
(74) *Attorney, Agent, or Firm* — Todd L. Juneau

(57) ABSTRACT

The invention relates to a frame for pads for pieces of furniture, in particular furniture legs, wherein the frame comprises a first floor contact layer on a first side and can be mounted detachably on the pad, wherein the frame comprises a second floor contact layer arranged on a second side of the frame which is different from the first side.

8 Claims, 2 Drawing Sheets

FURNITURE GLIDE

CROSS-REFERENCE TO RELATED APPLICATIONS

Figure 1:
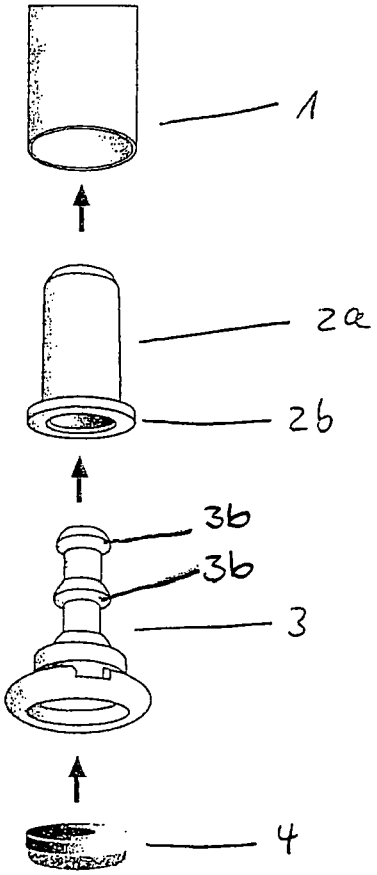

This application claims the benefit and priority of German Patent Application No. 20 2011 004 035.6, filed Mar. 17, 2011. The foregoing application is incorporated by reference herein in its entirety.

STATEMENT REGARDING FEDERALLY SPONSORED RESEARCH OR DEVELOPMENT

Not applicable

THE NAMES OF PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

Field of the Invention

The invention relates to a frame for pads for pieces of furniture, in particular furniture legs with the characteristics disclosed herein.

Pads for pieces of furniture, in particular furniture legs comprising a floor contact layer have been disclosed in the prior art. The floor contact layer can for instance allow the piece of furniture to slide on different types of flooring, such as for example carpet. With another design of the floor contact layer, the latter can also prevent damage to certain types of flooring, for example parquet. Moreover, undesirable noises can also be prevented, depending on the design of the floor contact layer. Furthermore, pads have been disclosed in which said frame can be mounted detachably to allow the simple exchange of frames.

The object of the invention is to upgrade these kinds of frames for pads for pieces of furniture.

The object of the invention is solved with a frame for pads for pieces of furniture, in particular furniture legs with the characteristics disclosed herein.

Advantageous designs and upgrades of the invention are also described herein.

DESCRIPTION OF RELATED ART INCLUDING INFORMATION DISCLOSED UNDER 37 CFR 1.97 and 1.98

Not applicable.

BRIEF SUMMARY OF THE INVENTION

The frame for pads for pieces of furniture, in particular furniture legs according to the invention, wherein the frame comprises a first floor contact layer on a first side and can be mounted detachably on the pad, is characterized in that the frame comprises a second floor contact layer arranged on a second side of the frame which is different from the first side. For floor contact layers which are subject to a certain degree of wear it is therefore possible to insert the frame into the pad in such a way that the second floor contact layer is used after the floor contact layer has been worn out.

According to a particularly preferred embodiment of the invention, the first floor contact layer and the second floor contact layer are made of different material. When the piece of furniture is used on different types of flooring, it is therefore possible to turn the frame effortlessly and to use the desired floor contact layer depending on the type of flooring.

The frame is preferably mounted in the pad in such a way that either the first floor contact layer or the second floor contact layer is facing the floor in order to allow the simple turning of the frame.

The first and second sides are preferably designed as opposite sides of the frame to allow the frame to be designed as space-saving as possible.

According to a particularly preferred embodiment of the invention, the first or the second floor contact layer are molded to the frame as a single piece. This allows a particularly simple and cost-effective manufacturing procedure.

The first floor contact layer is preferably made of felt, synthetic material, rubber, metal, porcelain, an elastic material or a glidable material. The second floor contact layer is preferably made of felt, synthetic material, rubber, metal, porcelain, an elastic material or a glidable material. This makes is possible to adjust the first and second floor contact layer to the respective type of flooring.

The pad for pieces of furniture, in particular furniture legs according to the invention comprises a holder part which can be rigidly connected with the piece of furniture, with a frame according to the invention detachably mountable in said holder part.

The frame is preferably detachably mountable in the holder part of the pad by means of a lock-in connection, in order to allow the simple exchange and turning of the frame.

The frame is preferably mountable in the holder part in such a way that either the first floor contact layer or the second floor contact layer is facing the floor.

BRIEF DESCRIPTION OF SEVERAL VIEWS OF THE DRAWING(S)

Figure 2A:
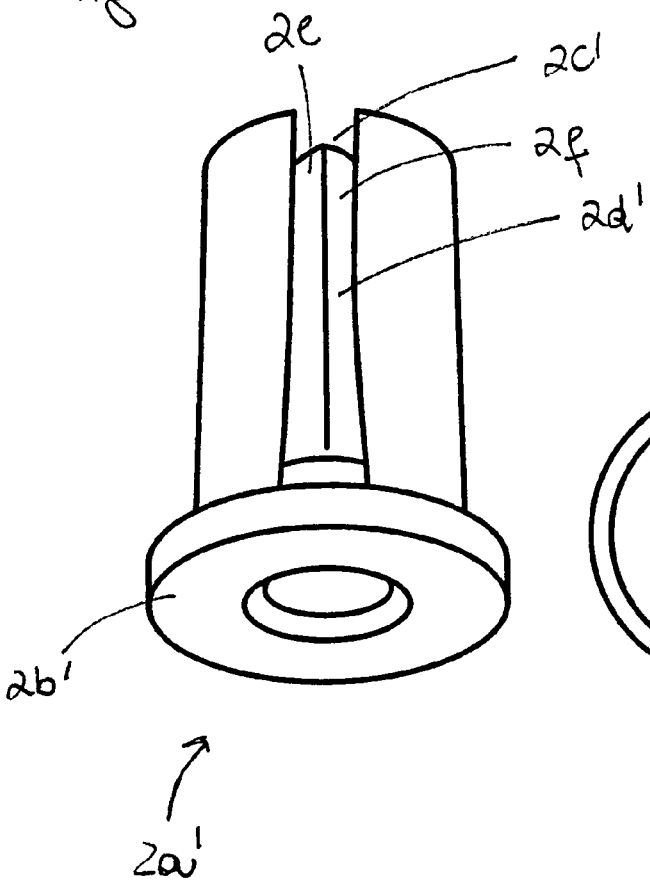
Figure 2B:
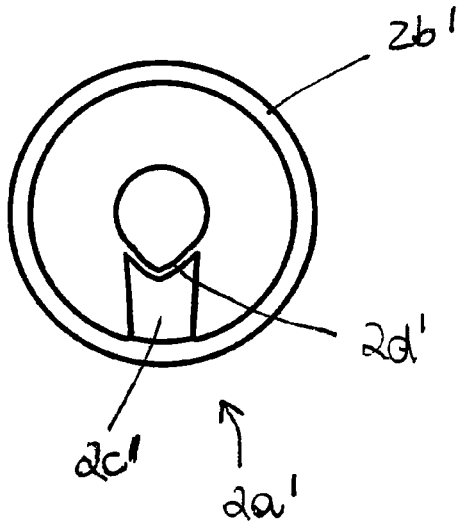

One exemplary embodiment of the invention is explained in detailed based on the figure. In the figures:

FIG. 1 shows a schematic longitudinal section through an exemplary embodiment of a frame inserted in a pad for pieces of furniture; and FIG. 2 shows a schematic longitudinal section through a second exemplary embodiment of a frame inserted into a pad for pieces of furniture.

DETAILED DESCRIPTION OF THE INVENTION

FIG. 1 illustrates a longitudinal section through a pad 10 having a holder part 12 on which a frame 20 can be detachably mounted. The holder part 12 of the pad 10 can be mounted on pieces of furniture, in particular furniture legs, for example by inserting it into a cavity on the free end of a chair leg 30 as illustrated. It can be mounted by means of gluing, pressing, clamping, screwing in, screwing down or similar. The holder part 12 comprises a recess 11 on the side facing the floor, in which the frame 20 can be detachably mounted. The frame 20 can be mounted in the recess 11 of the holder part 12 of the pad 10 for example by means of a lock-in connection. For this purpose, the holder part 12 comprises for instance a groove 15 in the recess 11, said groove in particular being designed around the entire circumference, in which a corresponding locking lug 25 of the frame 20 which can also in particular be designed around the entire circumference, locks into the recess 11 when the frame 20 is inserted.

The frame 20 is essentially designed as a disk-shaped element having a first side 20*a* and a second side 20*b* opposite the first side 20*a*. A first floor contact layer 21 is arranged on the first side 20*a*, while a second floor contact layer 22 is arranged on the second side 20*b*. The first and/or the second floor contact layers 21, 22 are rigidly connected with the frame 20, for example by means of gluing, screwing in, molding on as a single piece, injection molding or similar.

The first floor contact layer 21 and the second floor contact layer 22 can be made of the same material, which may make sense for example for floor contact layers 21, 22 that are subject to major wear.

The first floor contact layer 21 and the second floor contact layer 22 are preferably manufactured with different materials. Possible materials for this purpose include felt, synthetic material, rubber, metal, porcelain, elastic materials or glidable materials.

If the pad 10 is intended for use on a chair placed on both carpet as well as parquet flooring, the first floor contact layer 21 can be made for example of felt and the second floor contact layer 22 of a glidable material. If the chair is placed on carpet, the frame 20 is inserted into the recess 11 of the pad 10 in such a way that the second floor contact layer 22 made of glidable material is facing the floor. If the chair is used on parquet flooring, the frame 22 is removed from the recess 11 and turned in such a way that the first floor contact layer 21 made of felt is facing the floor. The detachable connection of the frame 20 in the recess 11 of the pad 10 allows the simple removal and replacement of the frame 20, depending on the type of flooring the piece of furniture will be placed on. In so doing, the use of two different floor contact layers 21, 22 made of different materials makes it possible that the frames 20 can be adjusted to different types of flooring without major expenses and without the need of providing separate frames.

The frame 20 illustrated in FIG. 2 only differs from the frame illustrated in FIG. 1, in that the floor contact layer 21 is molded to the frame 20 as a single piece and is therefore made in particular of the same material as the disk-shaped element of the frame 20. As a result, it is no longer necessary to mount the floor contact layer 21 on the frame 20 in an additional work step. All in all, this allows a particularly simple and cost-effective manufacturing process.

SEQUENCE LISTING

Not Applicable

I claim:

1. A furniture glide with a vibration damping sleeve, which is pressed into a piece of furniture, whereby a gliding surface is inserted into the vibration damping sleeve a) wherein the vibration damping sleeve comprises a slot, and b) wherein the slot is at least partially limited at the interior circumference of the vibration damping sleeve by a film spanning the slot.

2. The furniture glide of claim 1, wherein the vibration damping sleeve is made from a noise-absorbing material.

3. The furniture glide of claim 1, wherein that the vibration damping sleeve further comprises a flange.

4. The furniture glide of claim 1, further comprising wherein the gliding surface is inserted into a gliding surface accepting member, which is inserted into the vibration damping sleeve.

5. The furniture glide of claim 4, wherein the gliding surface is inserted into the gliding surface accepting member in an interchangeable fashion.

6. The furniture glide of claim 4, further comprising wherein the gliding surface accepting member is made from metal or plastic.

7. The furniture glide of claim 4, further comprising wherein the gliding surface or the gliding surface accepting member is a round, square, rectangular, oval, or other shape, which upon impression or insertion into the vibration damping sleeve leads to a fixed connection.

8. The furniture glide of claim 7, further comprising wherein the fixed connection between the gliding surface or the gliding surface accepting member and the vibration damping sleeve is produced by ribs or a cone shape.

* * * * *

UNITED STATES PATENT AND TRADEMARK OFFICE

CERTIFICATE OF CORRECTION

PATENT NO. : 8,621,711 B2
APPLICATION NO. : 13/318076
DATED : January 7, 2014
INVENTOR(S) : Roland Wagner It is certified that error appears in the above-identified patent and that said Letters Patent is hereby corrected as shown below:

On the title page item (87) PCT Pub. No., delete the PCT publication no. "WO2011/157385" and replace with the PCT publication no. --WO2010/130398--.

On the title page item (87) PCT Pub. Date, delete the PCT publication date "Dec. 22, 2011" and replace with the PCT publication date --Nov. 18, 2010--.

Signed and Sealed this
Twenty-seventh Day of May, 2014

Michelle K. Lee

Michelle K. Lee
*Deputy Director of the United States Patent and Trademark Office*